US010413094B2

(12) United States Patent
Boehnen et al.

(10) Patent No.: US 10,413,094 B2
(45) **Date of Patent: *Sep. 17, 2019**

(54) ARTICLE DIVIDER ASSEMBLY

(71) Applicant: LIBERTY HARDWARE MFG. CORP., Winston-Salem, NC (US)

(72) Inventors: Patrick William Boehnen, Summerfield, NC (US); Matthew James Klein, Apex, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/875,247

(22) Filed: Jan. 19, 2018

(65) Prior Publication Data

US 2018/0140114 A1 May 24, 2018

Related U.S. Application Data

(62) Division of application No. 14/656,848, filed on Mar. 13, 2015, now Pat. No. 9,907,415.

(51) Int. Cl.
*A47F 7/00* (2006.01)
*A47F 5/08* (2006.01)
(Continued)

(52) U.S. Cl.
CPC ..... *A47F 7/0014* (2013.01); *A47F 5/08* (2013.01); *A47F 5/105* (2013.01); *A47F 7/0021* (2013.01);
(Continued)

(58) Field of Classification Search
CPC .. A47F 7/0014; A47F 5/08; A47F 7/00; A47F 7/007; A47F 7/0021; A47F 7/0028;
(Continued)

(56) References Cited

U.S. PATENT DOCUMENTS 475,948 A 5/1892 Pease
739,027 A 9/1903 Raum
(Continued)

FOREIGN PATENT DOCUMENTS

CA 2505163 A1 10/2006
CN 203175303 U 9/2013
(Continued)

OTHER PUBLICATIONS www.thermatru.com/trade-professional/doorgallerydisplays.aspx, "Door Gallery Displays", Jul. 10, 2010, 31 pages.
(Continued)

*Primary Examiner* — Jennifer E. Novosad
(74) *Attorney, Agent, or Firm* — Brooks Kushman P.C.; Lora Graentzdoerffer

(57) ABSTRACT

An article divider assembly is provided with a support bracket adapted to be mounted to a retail display. A divider member extends from the support bracket and is sized to extend between a pair of articles at an upper region of the pair of articles to divide the articles without blocking an outward face of the articles. The divider member comprises a proximal end mounted to the support bracket and a distal end extending away from the support bracket. A display bracket is mounted to the distal end of the divider member.

20 Claims, 7 Drawing Sheets

(51) Int. Cl.
*A47F 7/14* (2006.01)
*A47F 5/10* (2006.01)
*A47F 5/00* (2006.01)

(52) U.S. Cl.
CPC ..... *A47F 7/0042* (2013.01); *A47F 7/146* (2013.01); *A47F 7/148* (2013.01); *A47F 2005/0075* (2013.01)

(58) Field of Classification Search
CPC .. A47F 7/005; A47F 7/14; A47F 7/146; A47F 7/148; A47F 7/16; A47F 7/0042; A47F 5/00; A47F 5/0006; A47F 2005/0075; A47F 5/01; A47F 5/0846; A47F 5/0853; A47F 5/0876; A47F 5/105; A47F 5/13; A47F 7/281; A47B 81/00; A47B 81/005; A47B 57/58; A47B 55/02; A47B 96/06; A47B 81/007
USPC ..... 211/86.01, 41.15, 41.16, 44, 45, 94.01, 211/60.1, 49.1, 189, 175, 193, 57.1, 59.1, 211/59.4, 184, 87.01; 248/214, 250, 248/227.2, 227.1, 228.6, 231.71
See application file for complete search history.

(56) References Cited

U.S. PATENT DOCUMENTS 805,570 A 11/1905 Maldaner
865,465 A 9/1907 Williams
949,915 A 2/1910 Schreiber
D43,274 S 11/1912 Goodwin
1,242,872 A 10/1917 Saunders
1,530,211 A 3/1925 Siemnash
1,688,255 A 10/1928 Wasch
1,714,692 A 5/1929 Pagel et al.
1,736,828 A 11/1929 Lobban
1,841,620 A 1/1932 McCoy
1,927,837 A 9/1933 Kingdon
2,113,288 A 4/1938 Berger
2,223,770 A 12/1940 Nagle
D129,731 S 9/1941 Luttrell
2,290,104 A 7/1942 Larson
2,501,609 A 3/1950 Midouhas
D165,358 S 12/1951 Baldwin
D174,553 S 4/1955 Harris
2,879,899 A 3/1959 Shenkin
2,884,136 A 4/1959 Leighton
2,887,219 A 5/1959 Lester, Jr.
2,937,743 A 5/1960 Buttery et al.
2,944,679 A 7/1960 Rubenstein
2,950,001 A 8/1960 Bucko
3,033,356 A 5/1962 Meyerson
3,095,970 A 7/1963 Gaulke
3,108,657 A 10/1963 Carlson
3,121,511 A 2/1964 Whitehead
3,175,694 A 3/1965 Reibold et al.
D202,485 S 10/1965 Fletcher et al.
3,233,753 A 2/1966 Rich
3,347,357 A 10/1967 De Soto et al.
3,359,573 A 12/1967 Casebolt
3,361,330 A 1/1968 Arneson
3,385,451 A * 5/1968 Anderson ..... A47F 7/0021 211/184
D211,321 S 6/1968 Ullmann
3,388,787 A 6/1968 Growney
3,403,777 A 10/1968 Bucko
3,468,593 A 9/1969 Catlett
3,517,459 A 6/1970 Schupper
3,517,801 A 6/1970 Cote
D224,692 S 8/1972 Gray
3,732,633 A 5/1973 Margolis et al.
D227,351 S 6/1973 Winton
3,777,883 A 12/1973 Hackenberg
3,777,896 A 12/1973 Ehrlich
3,889,813 A 6/1975 Wright
3,935,949 A 2/1976 Cohen
D240,503 S 7/1976 Crescenzi et al.
4,105,125 A 8/1978 Magness
4,109,786 A 8/1978 Roccaforte et al.
4,145,849 A 3/1979 Shindoll et al.
4,241,832 A 12/1980 Bliss
4,256,043 A 3/1981 Ovitz, III
D259,161 S 5/1981 Thauer
4,315,569 A 2/1982 Jaeschke
4,342,268 A 8/1982 Grava
4,378,905 A 4/1983 Roccaforte
4,385,687 A 5/1983 Dutcher
4,429,791 A 2/1984 Ruppel et al.
4,520,978 A 6/1985 Taub
4,634,010 A 1/1987 Otema
4,705,175 A 11/1987 Howard et al.
4,720,876 A 1/1988 Tomei et al.
4,750,609 A 6/1988 Felis
4,762,235 A 8/1988 Howard et al.
5,031,781 A 7/1991 Price et al.
D319,934 S 9/1991 Terrell et al.
D323,986 S 2/1992 Ferrero
5,111,943 A 5/1992 Ramey
D332,744 S 1/1993 McCooey
5,234,113 A 8/1993 Ramey
D343,075 S 1/1994 Cappel, III
5,297,685 A 3/1994 Ramey
5,305,898 A * 4/1994 Merl ..... A47F 5/0807 211/103
D349,458 S 8/1994 Verdaguer
5,346,076 A 9/1994 Hart
5,348,167 A 9/1994 Jensen
5,368,486 A 11/1994 Kurzman
5,372,278 A 12/1994 Leight
D355,586 S 2/1995 Wang
5,467,915 A 11/1995 Mattson
5,503,278 A 4/1996 Ishmael
5,509,541 A * 4/1996 Merl ..... A47B 45/00 211/103
D372,816 S 8/1996 Rose et al.
5,547,053 A 8/1996 Liang
D377,144 S 1/1997 Sawa
D383,335 S 9/1997 Shanahan et al.
5,675,936 A 10/1997 Kurth et al.
D392,820 S 3/1998 Shanahan et al.
5,769,247 A 6/1998 Merl
D396,805 S 8/1998 Broyles
5,822,810 A 10/1998 Chen
5,823,339 A 10/1998 Dunham et al.
5,848,446 A 12/1998 DeBraal
5,860,526 A 1/1999 Burke, Jr.
D405,369 S 2/1999 Dohner
5,887,782 A 3/1999 Mueller
D409,858 S 5/1999 Reed
5,941,384 A 8/1999 Schonhardt et al.
D417,978 S 12/1999 Reed
D425,972 S 5/2000 Smale
6,102,206 A 8/2000 Pride
6,102,502 A 8/2000 Melillo et al.
6,105,796 A 8/2000 Buchanan et al.
6,170,675 B1 1/2001 Follman et al.
6,182,738 B1 2/2001 Chen
6,250,044 B1 6/2001 Funk et al.
D451,305 S 12/2001 Chang et al.
D451,801 S 12/2001 Schillinger
6,340,092 B1 * 1/2002 McGrath, Jr. ..... A47F 7/0042 211/169
D454,067 S 3/2002 Schoening et al.
6,389,991 B1 5/2002 Morrisson
D461,974 S 8/2002 Hayden
6,461,705 B2 10/2002 Eichhorn
6,467,856 B1 10/2002 Chang et al.
6,484,890 B1 11/2002 Miller
D466,804 S 12/2002 Solland
D469,349 S 1/2003 Meeker et al.
6,594,973 B1 7/2003 Alpert et al.
D482,265 S 11/2003 Wicha

(56) References Cited

U.S. PATENT DOCUMENTS

| | | | | |
|---|---|---|---|---|
| 6,672,546 | B2 * | 1/2004 | Calleja | A47F 5/01 248/58 |
| 6,681,445 | B2 | 1/2004 | Huang | |
| 6,701,672 | B2 | 3/2004 | Teubert et al. | |
| 6,811,046 | B2 | 11/2004 | Stein | |
| 6,850,208 | B1 | 2/2005 | Ferrante | |
| 6,895,714 | B2 | 5/2005 | Teubert et al. | |
| D507,741 | S | 7/2005 | Lu et al. | |
| 6,913,151 | B2 | 7/2005 | Stevenson | |
| 6,935,514 | B2 | 8/2005 | Lackey et al. | |
| 7,137,172 | B2 | 11/2006 | Elmer | |
| 7,150,361 | B2 * | 12/2006 | Calleja | A47F 7/0021 211/49.1 |
| 7,178,681 | B2 * | 2/2007 | Libman | A47F 5/0815 211/106 |
| D548,066 | S | 8/2007 | Welch | |
| 7,264,126 | B1 | 9/2007 | Bergeron | |
| 7,273,084 | B2 | 9/2007 | Chen | |
| D556,031 | S | 11/2007 | Johnson | |
| 7,334,381 | B2 | 2/2008 | Mertz, II et al. | |
| 7,346,939 | B2 | 3/2008 | Perry | |
| D584,528 | S | 1/2009 | Neff et al. | |
| D588,905 | S | 3/2009 | Meeks et al. | |
| D593,409 | S | 6/2009 | Blick | |
| D594,742 | S | 6/2009 | Meier et al. | |
| 7,562,949 | B1 | 7/2009 | Nielsen | |
| D600,110 | S | 9/2009 | Cain | |
| 7,637,059 | B2 | 12/2009 | Chang et al. | |
| D607,724 | S | 1/2010 | Dreier et al. | |
| 7,748,527 | B2 | 7/2010 | Wisecarver et al. | |
| 7,762,508 | B2 | 7/2010 | Xu | |
| D622,083 | S | 8/2010 | Linder | |
| 7,828,151 | B2 | 11/2010 | Murdoch et al. | |
| 7,841,048 | B2 | 11/2010 | Tsai | |
| 7,900,784 | B1 | 3/2011 | Weigand et al. | |
| D639,652 | S | 6/2011 | Abdalkhani et al. | |
| 7,962,998 | B2 | 6/2011 | Proctor et al. | |
| D652,717 | S | 1/2012 | Shimoyama et al. | |
| 8,151,385 | B2 | 4/2012 | Goskowski et al. | |
| D660,988 | S | 5/2012 | Amend | |
| 8,191,707 | B2 | 6/2012 | McDonald et al. | |
| D668,540 | S | 10/2012 | Lutzig | |
| D668,889 | S | 10/2012 | Theisen | |
| 8,312,998 | B2 | 11/2012 | Theisen | |
| D685,260 | S | 7/2013 | Thielemier | |
| 8,490,331 | B2 | 7/2013 | Quesada | |
| D689,360 | S | 9/2013 | Adams | |
| D690,592 | S | 10/2013 | Ding | |
| D690,593 | S | 10/2013 | Kaps et al. | |
| D694,099 | S | 11/2013 | Ensslen, III et al. | |
| D699,563 | S | 2/2014 | McAdam | |
| 8,707,475 | B2 | 4/2014 | Johnson et al. | |
| D706,626 | S | 6/2014 | Lazar | |
| D709,363 | S | 7/2014 | Boehnen et al. | |
| 8,789,899 | B2 | 7/2014 | Pirro et al. | |
| D710,713 | S | 8/2014 | Fath | |
| 8,915,381 | B2 | 12/2014 | Brozak et al. | |
| D729,055 | S | 5/2015 | Lemnios et al. | |
| 9,108,775 | B2 | 8/2015 | Savakus | |
| D739,726 | S | 9/2015 | Lemnios et al. | |
| D758,771 | S | 6/2016 | Austin, III et al. | |
| D759,407 | S | 6/2016 | Denby | |
| D763,023 | S | 8/2016 | Austin, III et al. | |
| D767,380 | S | 9/2016 | Austin, III et al. | |
| 9,434,524 | B2 | 9/2016 | Kindig | |
| D777,018 | S | 1/2017 | Boehnen et al. | |
| D777,564 | S | 1/2017 | Boehnen et al. | |
| 9,676,543 | B2 | 6/2017 | Lemnios et al. | |
| D791,519 | S | 7/2017 | Jordan et al. | |
| 9,743,810 | B2 | 8/2017 | Schultz et al. | |
| 9,907,415 | B2 * | 3/2018 | Boehnen | A47F 7/0014 |
| 2001/0002660 | A1 | 6/2001 | Riga et al. | |
| 2001/0054258 | A1 | 12/2001 | Becken | |
| 2002/0134030 | A1 | 9/2002 | Conway | |
| 2002/0144375 | A1 | 10/2002 | Drucker et al. | |
| 2002/0157318 | A1 | 10/2002 | Teubert et al. | |
| 2003/0019982 | A1 | 1/2003 | Wing et al. | |
| 2003/0047528 | A1 | 3/2003 | Stein | |
| 2003/0189018 | A1 | 10/2003 | Hopkins et al. | |
| 2004/0159049 | A1 | 8/2004 | Teubert et al. | |
| 2004/0177437 | A1 | 9/2004 | Perry | |
| 2004/0238465 | A1 | 12/2004 | Mercure | |
| 2004/0245195 | A1 | 12/2004 | Pride | |
| 2005/0006332 | A1 | 1/2005 | Stein | |
| 2005/0115202 | A1 | 6/2005 | Mertz, II et al. | |
| 2005/0115860 | A1 | 6/2005 | Mertz, II et al. | |
| 2005/0236299 | A1 | 10/2005 | Weber | |
| 2006/0043032 | A1 | 3/2006 | McHugh | |
| 2006/0196838 | A1 | 9/2006 | Mercure et al. | |
| 2006/0208150 | A1 | 9/2006 | Elmer et al. | |
| 2007/0045204 | A1 | 3/2007 | Huard et al. | |
| 2007/0295680 | A1 | 12/2007 | Budge et al. | |
| 2008/0073469 | A1 | 3/2008 | Mushan et al. | |
| 2008/0148639 | A1 | 6/2008 | Jakob-Bamberg et al. | |
| 2008/0148692 | A1 | 6/2008 | Wisecarver et al. | |
| 2008/0277363 | A1 | 11/2008 | McDonough | |
| 2009/0115299 | A1 | 5/2009 | Ricereto | |
| 2010/0107497 | A1 | 5/2010 | Hulst et al. | |
| 2010/0181267 | A1 | 7/2010 | Theisen | |
| 2010/0264058 | A1 | 10/2010 | Krause | |
| 2011/0035871 | A1 | 2/2011 | Seymour et al. | |
| 2011/0113547 | A1 | 5/2011 | O'Connell | |
| 2012/0005822 | A1 | 1/2012 | Daubmann et al. | |
| 2012/0036628 | A1 | 2/2012 | O'Connell | |
| 2012/0233926 | A1 | 9/2012 | Chang et al. | |
| 2012/0259743 | A1 | 10/2012 | Pate, Jr. | |
| 2013/0093298 | A1 | 4/2013 | Ehmke et al. | |
| 2013/0140319 | A1 | 6/2013 | Tam et al. | |
| 2013/0161276 | A1 | 6/2013 | Breeden et al. | |
| 2013/0325670 | A1 | 12/2013 | Austin, III et al. | |
| 2014/0032447 | A1 | 1/2014 | Fisher | |
| 2014/0173990 | A1 | 6/2014 | Schachter et al. | |
| 2014/0237715 | A1 | 8/2014 | Wei | |
| 2014/0250795 | A1 | 9/2014 | Wei | |
| 2014/0259363 | A1 | 9/2014 | Ball et al. | |
| 2014/0290001 | A1 | 10/2014 | Hasegawa | |
| 2014/0319988 | A1 | 10/2014 | Dietz et al. | |
| 2014/0331564 | A1 | 11/2014 | Wei | |
| 2015/0096117 | A1 | 4/2015 | Forrest et al. | |
| 2015/0208875 | A1 | 7/2015 | Austin, III et al. | |
| 2015/0210113 | A1 | 7/2015 | Yang | |

FOREIGN PATENT DOCUMENTS

| | | | |
|---|---|---|---|
| CN | 204326804 | U | 5/2015 |
| CN | 204370691 | U | 6/2015 |
| DE | 2149016 | | 4/1973 |
| DE | 9306878 | U1 | 9/1993 |
| DE | 202009004111 | U1 | 8/2009 |
| EP | 1020154 | A2 | 7/2000 |
| EP | 2317052 | A2 | 5/2011 |
| EP | 2774519 | A1 | 9/2014 |
| GB | 827312 | | 2/1960 |
| JP | 2001095657 | A | 4/2001 |
| JP | 2003237846 | A | 8/2003 |
| WO | 2005035396 | A2 | 4/2005 |
| WO | 2005035396 | A3 | 4/2005 |
| WO | 2008076224 | A1 | 6/2008 |
| WO | 2008133531 | A1 | 11/2008 |
| WO | 2009029358 | A1 | 3/2009 |

OTHER PUBLICATIONS http://www.johnsonhardware.com/doordisplay.htm, "Johnson Hardware Door Panel Display Unit", Dec. 16, 2010, 2 pages.

Quality Craft, "Installation Manual Shower Unit", Model No. 961WUX006WHI, Mar. 9, 2011, 14 pages.

HouseImprovements, Video: "How to Install Glass Sliding Shower Doors", Oct. 4, 2012, https://www.youtube.com/watch?v=u88j284_jAk, 32:25.

* cited by examiner

ARTICLE DIVIDER ASSEMBLY

CROSS-REFERENCE TO RELATED APPLICATIONS

This application is a division of U.S. application Ser. No. 14/656,848 filed Mar. 13, 2015, now U.S. Pat. No. 9,907,415 B2, the disclosure of which is hereby incorporated in its entirety by reference herein.

TECHNICAL FIELD

Various embodiments relate to article divider assemblies for retail displays of articles.

BACKGROUND

Retail displays of shower door assemblies are disclosed in U.S. Patent Application Publication 2013/0325670 A1, which published to Austin, III et al. on Dec. 5, 2013.

SUMMARY

According to at least one embodiment, an article divider assembly is provided with a support bracket adapted to be mounted to a retail display. A divider member extends from the support bracket and is sized to extend between a pair of articles at an upper region of the pair of articles to divide the articles without blocking an outward face of the articles.

According to another embodiment, a retail display is provided with a frame. An article divider assembly is provided with a support bracket mounted to the frame. A divider member extends from the support bracket and is sized to extend between a pair of articles at an upper region of the pair of articles to divide the articles without blocking an outward face of the articles. At least one article is provided in the display adjacent to the divider member.

According to at least another embodiment, an article divider assembly is provided with a support bracket adapted to be mounted to a retail display. A divider member extends from the support bracket and is sized to extend between a pair of articles at an upper region of the pair of articles to divide the articles. The divider member comprises a proximal end mounted to the support bracket and a distal end extending away from the support bracket. A display bracket is mounted to the distal end of the divider member.

According to at least one embodiment, a method for displaying an article provides an article divider assembly with a support bracket mounted to a retail display, and a plurality of divider members extending from the support bracket. An article is provided in the display with an upper region of the article between a pair of divider members without blocking an outward face of the article.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Conventional shower door assemblies were retailed preassembled, which resulted in limited design choice combinations, and large packaged assemblies. U.S. Patent Application Publication 2013/0325670 A1, which published to Austin, III et al. on Dec. 5, 2013 discloses a retail display for shower door assemblies, wherein shower door assemblies are retailed in individually packaged components. The individual components may include glass panels, frames, lineals and hardware.

Figure 1:
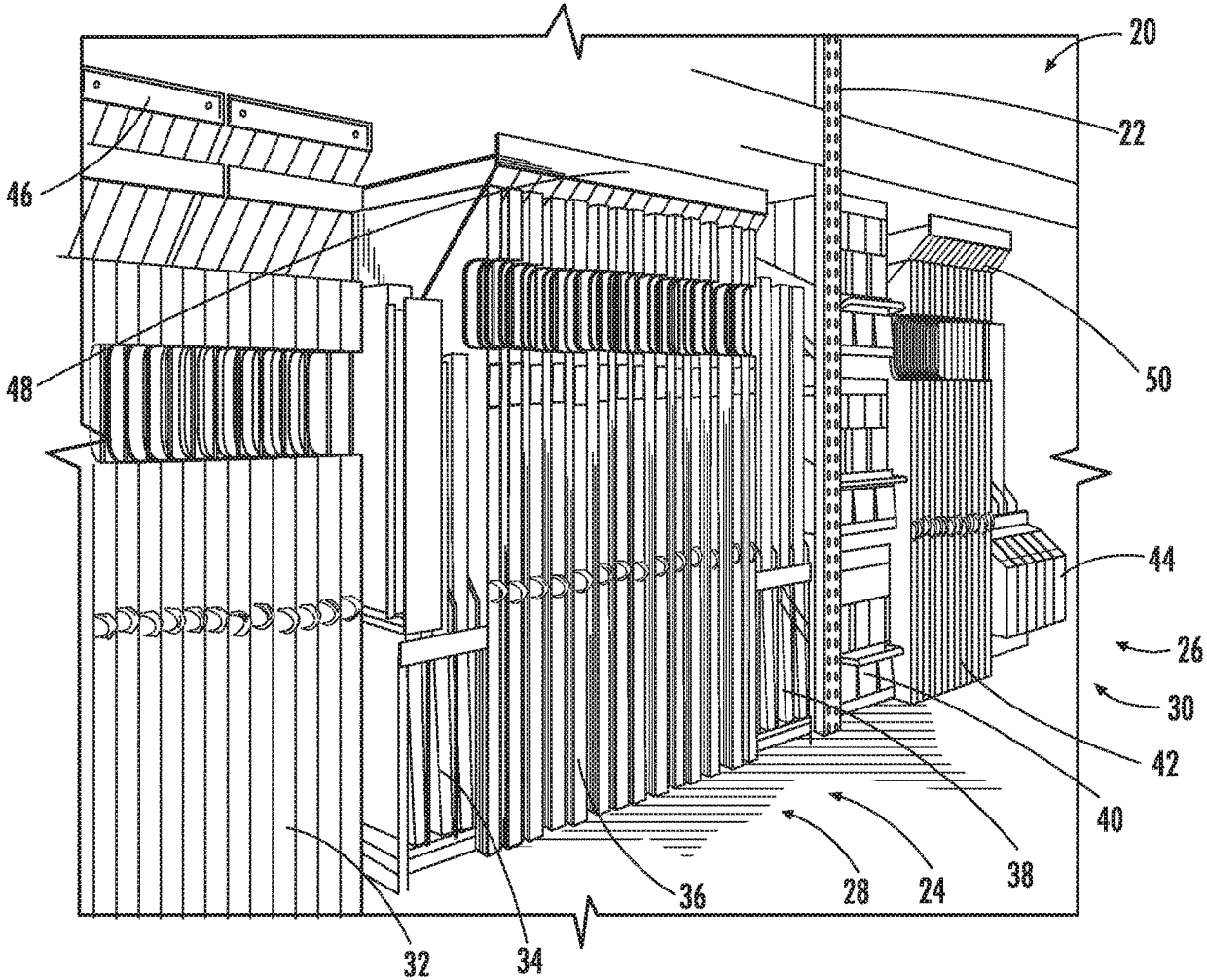
FIG. 1 is a front perspective view of a retail display according to an embodiment, with a plurality of article divider assemblies according to embodiments for dividing retail articles.

FIG. 1 illustrates a retail display system according to an embodiment and referenced generally by numeral 20. The retail display system 20 includes a frame 22, which may be a conventional point-of-sale frame 22 for displaying retail articles. The frame 22 defines multiple bays, such as bays 24, 26 as depicted for displaying shower door assembly components. The retail display system 20 is provided by, for example, a pair of retail shower door display assemblies 28, 30. The display system 20 is sized to be displayed within a retail store aisle, such as a home improvement store. The display system 20 is utilized for both displaying and retailing shower door components. The frame 22 sized to be received within a retail store aisle; and may be sized the same as conventional shelving for preassembled doors for easy replacement.

Shower door assemblies are conventionally categorized by function or type. For example, shower door assemblies include sliding shower door assemblies 28, which are depicted in the first bay 24 and pivoting shower door assemblies 30, which are depicted in the second bay 26. The first decision a consumer of shower door assemblies may need to decide is which style or category 28, 30 of shower door assembly is desired. Once the consumer selects a category 28, 30 the consumer may approach the corresponding bay 24, 26.

The sliding shower door assembly 28 includes an array of articles or shower door glass panes 32, which may be for sliding tub doors, for example. The shower door glass panes 32 may vary in style. The shower door glass panes 32 each have a standard height, a standard thickness, and a standard width for that application. An array of shower door tracks 34 is provided in the retail display system 20 with standard dimensions for the sliding tub door application. The tracks 34 may also vary in style. The separate packaging permits the customer to select from a large combination of varieties due to the interchangeability of the glass panes 32 and the tracks 34. The tracks 34 depicted may be guide tracks 34 for sliding a pair of shower door glass panes 32 within the guide tracks 34. Alternatively to, or in addition to, the tracks 34 may be frames for the shower door glass panes 32.

The sliding shower door assemblies 28 also include an array of shower door glass panes 36 for sliding shower doors. The shower door glass panes 36 include a standard height, which is typically greater than that for a sliding tub door. The shower door glass panes 36_have a standard thickness, and a standard width, for example, to span up to a forty-eight inch shower door opening.

The sliding shower door assemblies 28 include an array of shower door tracks 38 for the sliding shower door panes 36. Next, an array of shower door hardware 40 is oriented within the second bay 26 of the retail display system 20.

The retail display system 20 also includes an array of shower door glass panes 42 for pivoting shower door assemblies 30. An array of shower tracks and hardware 44 for the pivoting shower door assemblies 30 are also provided.

The retail shower door display system 20 provides a large variation of shower door assemblies 28, 30 without limits provided in prepackaged assemblies. The retail shower door display system 20 allows the consumer to custom configure a shower door based on the consumer's selection. The retail shower door display system 20 enables the consumer to mix and match style, finish, and glass textures for a customized sliding-tub shower door assembly 28, sliding shower door assembly 28 or a pivot shower door assembly 30. The retail shower door display system 20 permits the manufacturer to retail more Stock Keeping Units (SKUs) in the retail shower door display system 20 than would be practical with traditional preassembled and prepackaged shower door assemblies. The consumer can avoid having to lift, carry and transport a single total weight package due to the separation of the components. Consumers can also more readily transport components in vehicles due to an ability to place each packaged component in a vehicle interior and trunk due to separate packaging. Also, the customer can purchase replacement parts without a need to replace an entire shower door assembly in case of component repair when a specific component requires replacement, but the entire assembly does not require replacement. The customer can purchase replacement parts for new remodeling efforts where a glass or frame finish change is desired. The customer can purchase replacement parts for future product maintenance when one or more components require replacement due to wear or damage.

The manufacturer can also avoid steps of shipping the components to a common facility for assembling and packaging. The manufacturer can also more readily maintain inventory; easily add new products to the retail shower door display system 20; and regionalize the product mix.

Conventional preassembled shower door assemblies included packaging with a greater footprint than the packaging of the shower door glass panes 32, 36, 42. The prepackaged, preassembled shower door assemblies had a substantial footprint that was sufficient for supporting the weight of the package and its components. The modularity provided in the retail display system results in packages that have a much thinner footprint, which may result in leaning of one or more articles, such as shower door glass panes 32, 36, 42. As multiple articles lean, the cumulative weight may result in much difficulty in removing one or more articles 32, 36, 42. To prevent the leaning of articles, a plurality of article divider assemblies 46, 48, 50 are mounted to the frame 22 to manage the weight of the articles 32, 36, 42. The article divider assemblies 46, 48, 50 may each individually contact or receive the articles 32, 36, 42 at an upper region of the article 32, 36, 42, above the center of gravity so that the articles 32, 36, 42 stay in place with minimal mechanical effort.

Figure 2:
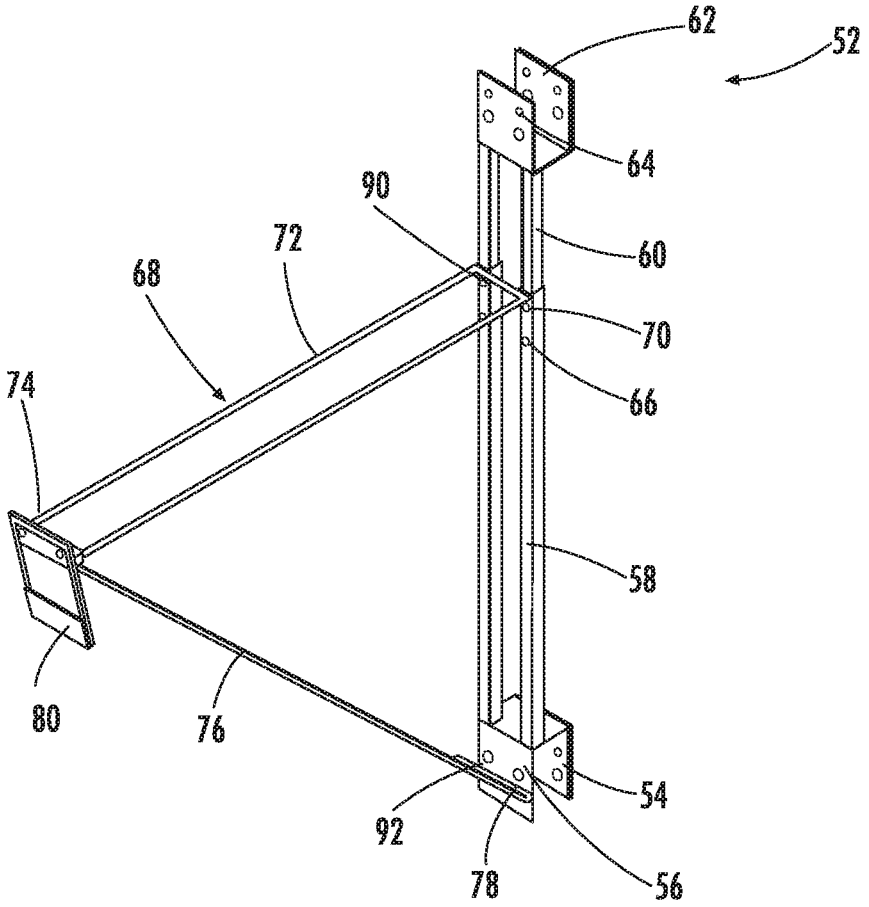
FIG. 2 is a perspective view of an article divider assembly according to an embodiment.
Figure 4:
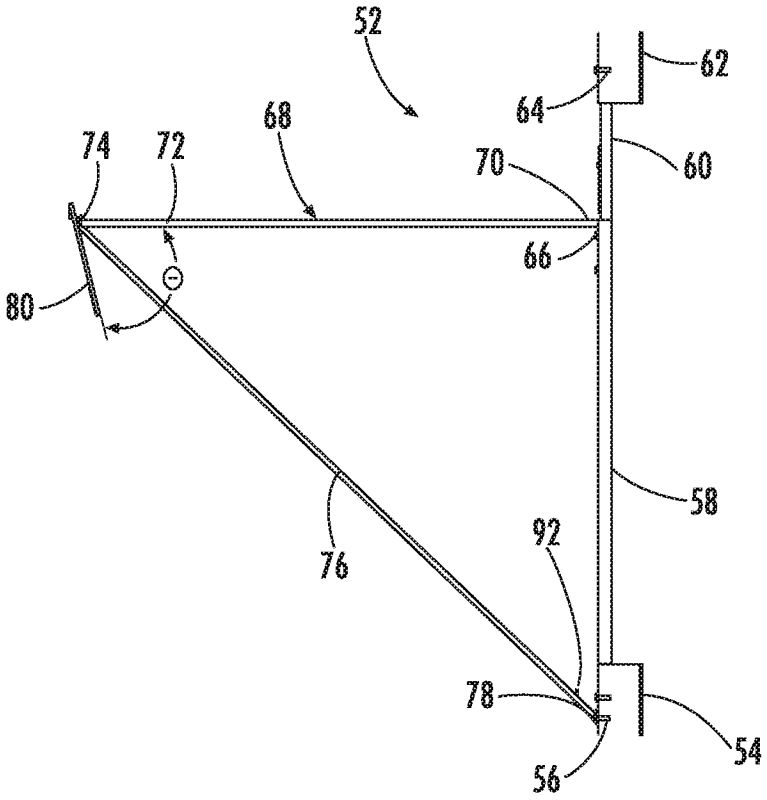
FIG. 4 is a right side elevation view of the article divider assembly of FIG. 2.
Figure 3:
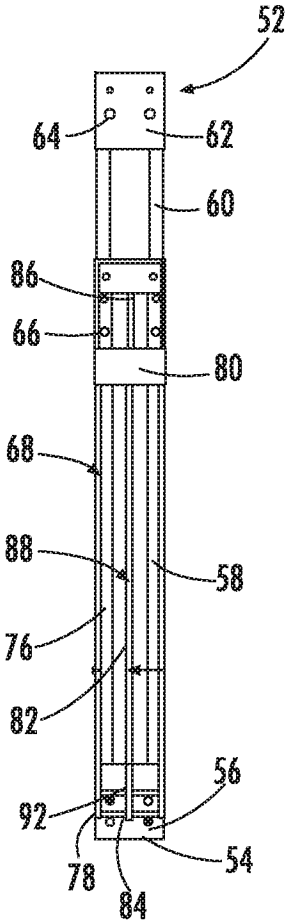
FIG. 3 is a front elevation view of the article divider assembly of FIG. 2.

FIGS. 2-4 illustrate an article divider assembly 52 according to an embodiment, which may be employed as any of the article divider assemblies 46, 48, 50 in the retail display system 20 of the prior embodiment. The article divider assembly 52 has a lower support bracket 54 that is sized to receive a cross member of the frame 22 for mounting the article divider assembly 52 to the frame 22. The lower support bracket 54 includes a fastener configuration 56 to match a corresponding fastener configuration in the cross member of the frame 22. A pair of sleeves 58 extend upright from the lower support bracket 54. A pair of posts 60 is received in the sleeves 58 for translation relative to the sleeves 58. An upper support bracket 62 is mounted to the pair of posts 60 and is also sized to receive another cross member of the frame 22. The upper support bracket 62 is adjustable relative to the lower support bracket 54 for expanding to receive a pair of cross members of the frame 22 and for accommodating various beam spacing in frames 22. The upper support bracket 62 also includes a fastener configuration 64 for securing the upper support bracket 62 the frame 22. A fastener configuration 66 is provided engaging the sleeves 58 and the posts 60 for securing the posts 60 relative to the sleeves 58 at an adjusted height.

The article divider assembly 52 includes two divider members 68 for dividing the articles. Each divider member 68 has an upper proximal end 70 mounted to the sleeves 58. A horizontal bar 72 extends forward from the upper proximal end and away from the sleeves 58 to a distal end 74. An angled bar of each article divider member 68 extends to the lower support bracket 54 at a lower proximal end 78. Each divider member 68 may formed from a heavy wire, such as a quarter inch diameter wire, which may be welded at each connection for forming the article divider assembly 52.

A stabilizer bracket 80 is mounted to the distal ends 74 of the divider members 68 to maintain a spacing between the divider members 68. As illustrated in FIG. 3, an intermediate angled bar 82 is provided between the angled bars 76 of the divider members 68. The intermediate angled bar 82 is mounted to the lower support bracket 54 at a proximal end 84, and to the stabilizer bracket 80 at a distal end 86. The intermediate angled bar 82 provides a third divider member 88.

The article divider members 68, 88 are incrementally spaced apart a distance to receive an article, in other words a distance that is greater than a thickness of the article, but less than a thickness of two articles to prevent receipt of more than one article. The article divider members 68, 88 provide lateral support only to the received articles, and do not contact or block an outward facing surface of the article so that a user may merely slide an article into or out of the article divider assembly 52, and consequently the retail display system 20. The stabilizer bracket 80 is oriented spaced above a top surface of the articles for clearance of the articles relative to the stabilizer bracket 80.

A rod 90 is welded to the upper proximal ends 70 of the horizontal bars 72 to add rigidity and maintain spacing. Another rod 92 is welded to the angled bars 76, 82 to add rigidity, and maintain spacing. The lower rod 92 sets a limit for receipt of articles and prevents the articles from being pushed too far into the display system 20.

The stabilizer bracket 80 also functions as a display bracket for receipt of indicia indicative of information regarding a corresponding article. In other words, the stabilizer bracket 80 is sized and shaped for receipt of price stickers. Typically, price stickers are provided on an upper cross member of the frame 22, which may be multiple feet above the associated article, which may lead to confusion associating a price sticker with an article. The stabilizer/display bracket 80 is oriented directly above the article for convenience of the retailer and the purchaser. The stabilizer/display bracket 80 provides an acute angle Θ, such as seventy-five degrees, relative to the horizontal bars 72 so that an outward face is angled downward for improving a viewing angle of the retailer and customer.

By holding the articles individually upright as assisted by the article divider assembly 52, a store associate can more readily determine quantities of stocked products for various styles for restocking and or reordering.

Figure 6:
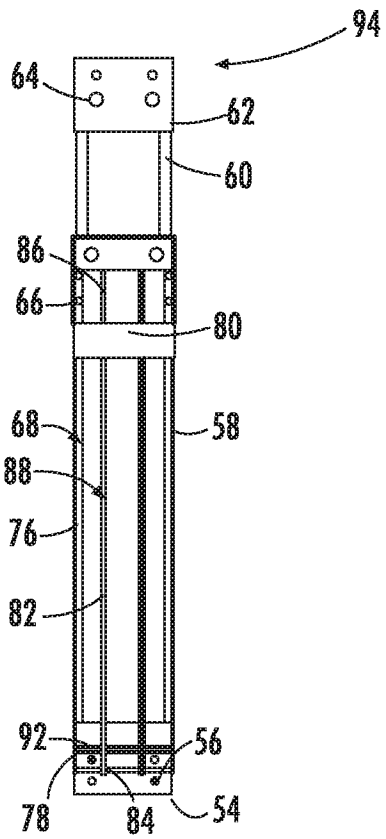
FIG. 6 is a front elevation view of the article divider assembly of FIG. 5.
Figure 5:
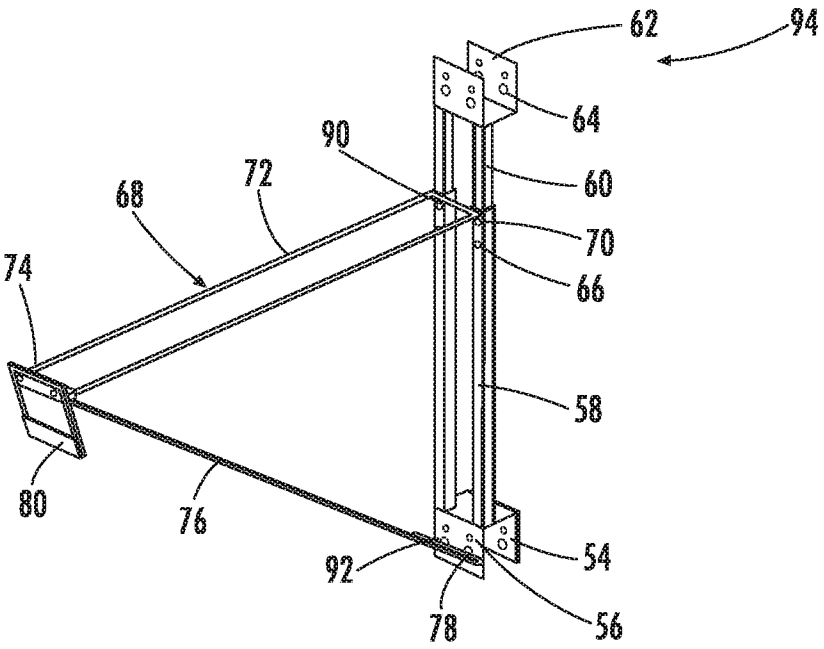
FIG. 5 is a perspective view of an article divider assembly according to another embodiment.
Figure 8:
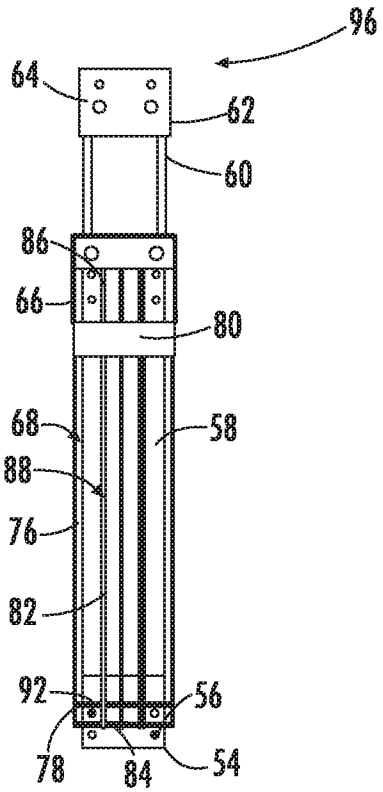
FIG. 8 is a front elevation view of the article divider assembly of FIG. 7.
Figure 7:
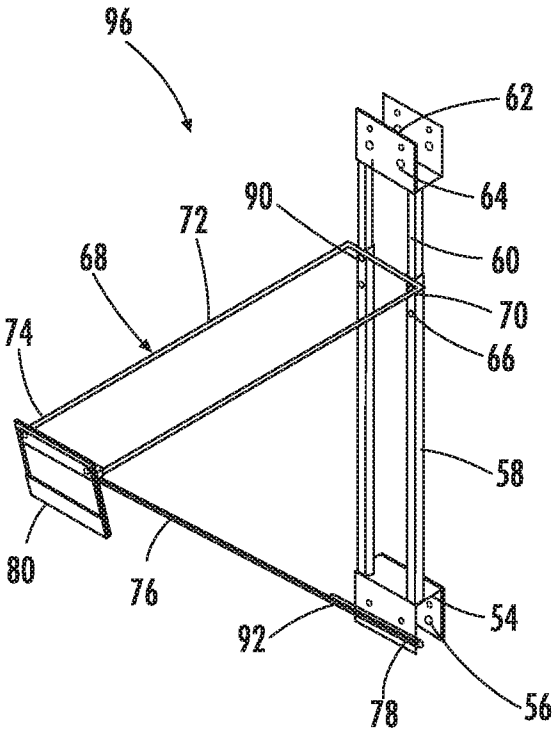
FIG. 7 is a perspective view of an article divider assembly according to another embodiment.

FIGS. 5 and 6 illustrate an article divider assembly 94 according to another embodiment. The article divider assembly 94 is similar to the prior embodiment and like elements retain like reference numerals. In contrast, the article divider assembly 94 is wider with two intermediate angled bars 82. Similarly, FIGS. 7 and 8 illustrate an article divider assembly 96 according to yet another embodiment with three intermediate angled bars 82. The various embodiments depict that the article divider assemblies 52, 94, 96 are scalable for any number of divider members 68, 88 as a display may require.

Figure 9:
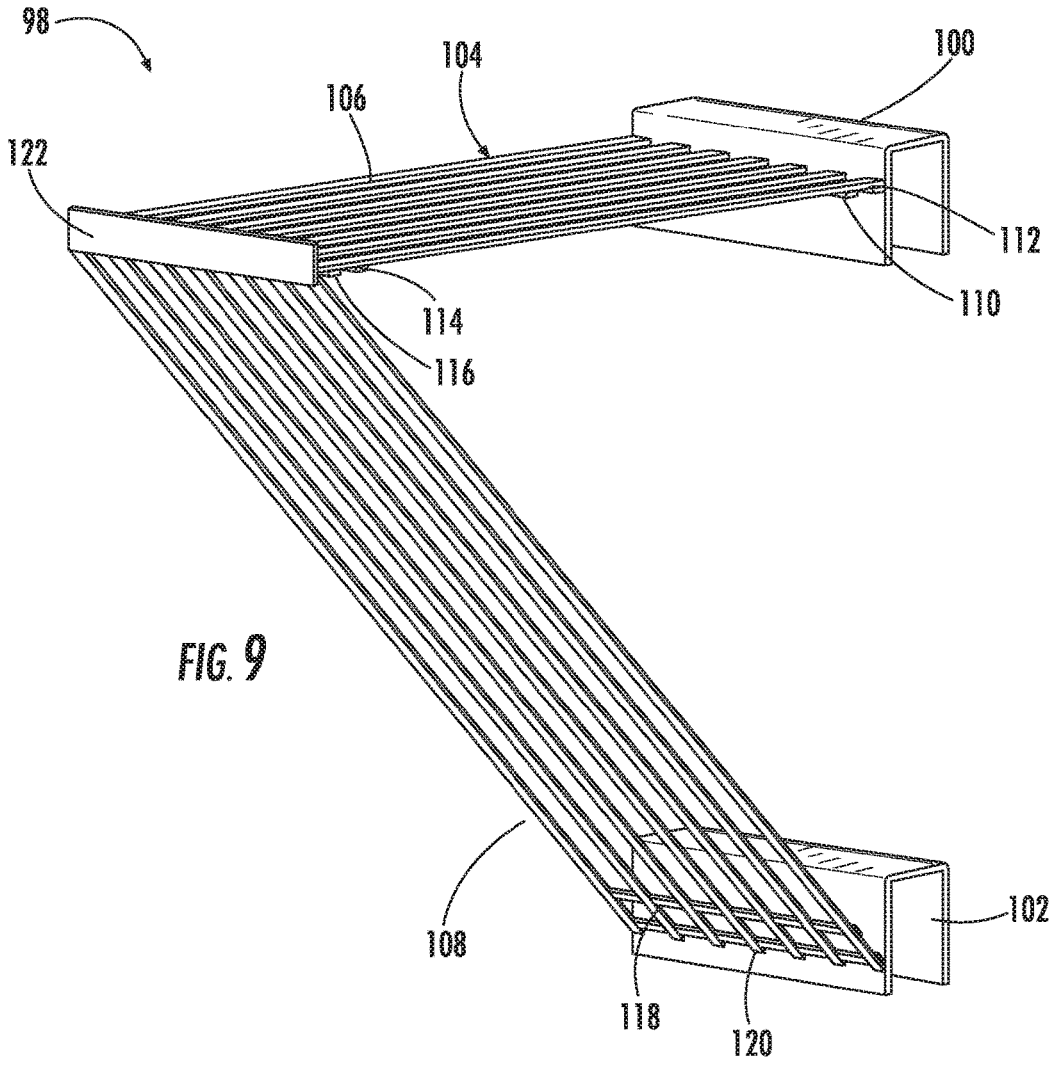
FIG. 9 is a perspective view of an article divider assembly according to another embodiment.
Figure 10:
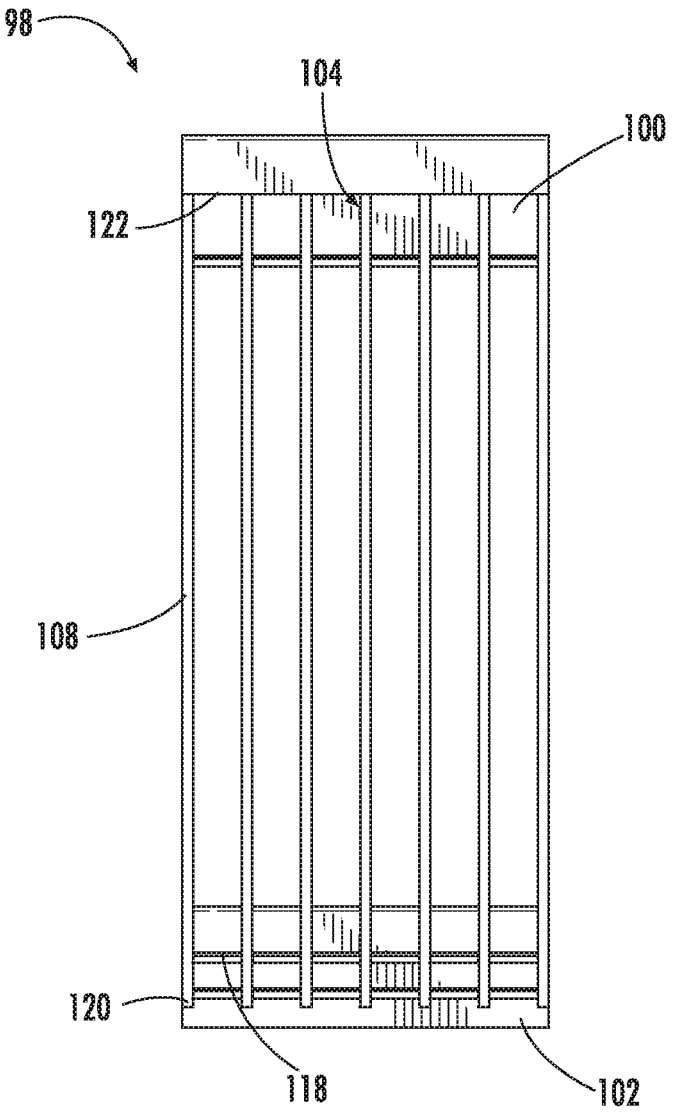
FIG. 10 is a front elevation view of the article divider assembly of FIG. 9.

FIGS. 9 and 10 illustrate an article divider assembly 98 according to yet another embodiment. The article divider assembly 98 is similar to the prior embodiments but is simplified without adjustability. Upper and lower support brackets 100, 102 are both open downward to be concurrently installed onto a pair of cross members of the frame. The article divider assembly 98 includes a plurality of divider members 104 that each include a horizontal bar 106 and an angled bar 108. A pair of rods 110 is provided on the horizontal bars 106 adjacent an upper proximal end of the divider members 104 for spacing and support. Another pair of rods 114 is provided at a distal end 116 of the divider members 104. A lower pair of rods 118 is provided at a lower proximal end 120 of the divider members 104. A stabilizer/display bracket 122 is provided at the distal ends 116 of the divider members 104.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A retail display comprising:

a frame;

at least one article divider assembly mounted to the frame, the article divider assembly comprising:

a support bracket mounted to the frame, a divider member extending from the support bracket and sized to extend between a pair of articles at an upper region of the pair of articles to divide the articles without blocking an outward face of the articles, wherein the divider member comprises a plurality of incrementally spaced divider members extending from the support bracket, wherein each of the plurality of incrementally spaced divider members comprises a proximal end mounted to the support bracket and a distal end extending away from the support bracket, and a stabilizer bracket mounted to the distal ends of the plurality of incrementally spaced divider members; and at least one pair of articles provided in the display adjacent to the divider member; and wherein each of the plurality of spaced divider members is spaced apart in a thickness direction of the at least one pair of articles.

2. The retail display of claim 1 wherein each of the plurality of incrementally spaced divider members is spaced apart a distance that is greater than a thickness of one of the pair of articles.

3. The retail display of claim 2 wherein each of the plurality of incrementally spaced divider members is spaced apart the distance that is less than a combined thickness of the pair of articles.

4. The retail display of claim 1 wherein the support bracket comprises an upper support bracket and a lower support bracket; and wherein the divider member extends from the upper support bracket and the lower support bracket.

5. The retail display of claim 4 wherein at least one of the upper support bracket and the lower support bracket is adjustable relative to the other.

6. The retail display of claim 1 further comprising a display bracket mounted to the distal end of the divider member.

7. The retail display of claim 6 wherein indicia indicative of article information is provided on the display bracket.

8. The retail display of claim 6 wherein the display bracket is oriented above an upper height of the pair of articles for clearance of the articles.

9. The retail display of claim 6 wherein the display bracket is angled relative to the divider member to face downward.

10. The retail display of claim 1 wherein the divider member is provided above a center of gravity of the at least one pair of articles.

11. The retail display of claim 1 wherein the at least one pair of articles comprises a shower door component.

12. The retail display of claim 1 wherein each of the at least one pair of articles is provided in the display in between a pair of the of the plurality of incrementally spaced divider members.

13. A method for displaying a shower door component, the method comprising the steps of:

providing a support bracket mounted to a retail display;

providing a plurality of laterally spaced apart divider members extending from the support bracket;

providing a display bracket with an outward display face, mounted to distal ends of the plurality of divider members;

providing a shower door component in the display with an upper region of the shower door component between a pair of laterally spaced apart divider members with an outward display face in the same direction as the outward display face of the display bracket; and displaying the shower door component below the display bracket without blocking the outward display face of the shower door component.

14. A retail display comprising:

a frame;

at least one article divider assembly mounted to the frame, the article divider assembly comprising:

a support bracket mounted to the frame, a divider member extending from the support bracket and sized to extend between a pair of articles at an upper region of the pair of articles to divide the articles without blocking an outward face of the articles, wherein the divider member comprises a plurality of incrementally spaced divider members extending from the support bracket, wherein each of the plurality of incrementally spaced divider members comprises a proximal end mounted to the support bracket and a distal end extending away from the support bracket, and a stabilizer bracket mounted to the distal ends of the plurality of incrementally spaced divider members;

at least one pair of articles provided in the display adjacent to the divider member; and a display bracket mounted to the distal end of the divider member; and wherein the display bracket is angled relative to the divider member to face downward.

15. The retail display of claim 14 wherein each of the at least one pair of articles is provided in the display in between a pair of the of the plurality of incrementally spaced divider members.

16. The retail display of claim 14 wherein each of the plurality of incrementally spaced divider members is spaced apart a distance that is greater than a thickness of one of the pair of articles; and wherein each of the plurality of incrementally spaced divider members is spaced apart the distance that is less than a combined thickness of the pair of articles.

17. The retail display of claim 14 wherein the support bracket comprises an upper support bracket and a lower support bracket;

wherein the divider member extends from the upper support bracket and the lower support bracket; and wherein at least one of the upper support bracket and the lower support bracket is adjustable relative to the other.

18. The retail display of claim 14 wherein the display bracket is oriented above an upper height of the pair of articles for clearance of the articles.

19. The retail display of claim 14 wherein the divider member is provided above a center of gravity of the at least one pair of articles.

20. The retail display of claim 14 wherein the at least one pair of articles comprises a shower door component.

* * * * *